United States Patent [19]

Vendramini

[11] 4,309,854

[45] Jan. 12, 1982

[54] TELESCOPIC MAST

[76] Inventor: Dante Vendramini, 21, rue Félix Faure, 92700 Colombes, France

[21] Appl. No.: 75,710

[22] Filed: Oct. 15, 1979

[30] Foreign Application Priority Data

Sep. 18, 1978 [FR] France ..... 78 26728
Sep. 12, 1979 [FR] France ..... 79 22836

[51] Int. Cl.[3] ..... B66C 23/06

[52] U.S. Cl. ..... 52/121; 52/118; 212/267; 212/264

[58] Field of Search ..... 52/118, 121, 67; 212/267, 264, 230

[56] References Cited

U.S. PATENT DOCUMENTS

| | | | |
|---|---|---|---|
| 1,644,613 | 10/1927 | Royer et al. | 52/121 |
| 2,795,303 | 6/1957 | Muehlhause et al. | 52/121 |
| 2,942,700 | 6/1960 | Parmenter et al. | 52/121 |
| 3,248,830 | 5/1966 | Maynard | 52/67 |
| 3,302,345 | 2/1967 | Ballantine | 52/121 |
| 3,328,921 | 7/1967 | Keslin | 52/121 |
| 3,403,485 | 10/1968 | Cernosek | 52/121 |
| 3,648,850 | 3/1972 | Rochon et al. | 52/121 X |
| 3,745,725 | 7/1973 | Boucaud | 52/67 |

FOREIGN PATENT DOCUMENTS

| | | | |
|---|---|---|---|
| 315293 | 10/1919 | Fed. Rep. of Germany . | |
| 1290035 | 9/1972 | United Kingdom . | |
| 1409888 | 10/1975 | United Kingdom | 52/121 |

*Primary Examiner*—Alfred C. Perham

[57] ABSTRACT

A telescopic mast having a plurality of elements comprising the mast wherein the elements are slidably arranged in relation to each other, together with cables for the erection of the mast, wherein the cables are before the erection of the mast connected to all of the elements and the erection of the mast is carried out by a successive sliding of each element on the element therebelow, further including provision for separating the cables of each element after the end of the hoisting operation of that element.

19 Claims, 23 Drawing Figures

$1_1$
3
$2_{12}$
$2_{11}$
$31_2, 32_2$
$30_2$
$30_1$
30
$31_1, 32_1$
31, 32
25
1
26, 27
$2_2$
14, 13
20
22
$9_2$
$2_1$
$11_2, 10_2$
12
$9_1$
4
6
$11_1, 10_1$
21
19
5
6a
34, 35
33
8
18
$134_2$
2
137
138
25
139
134
$134_1$

FIG_2
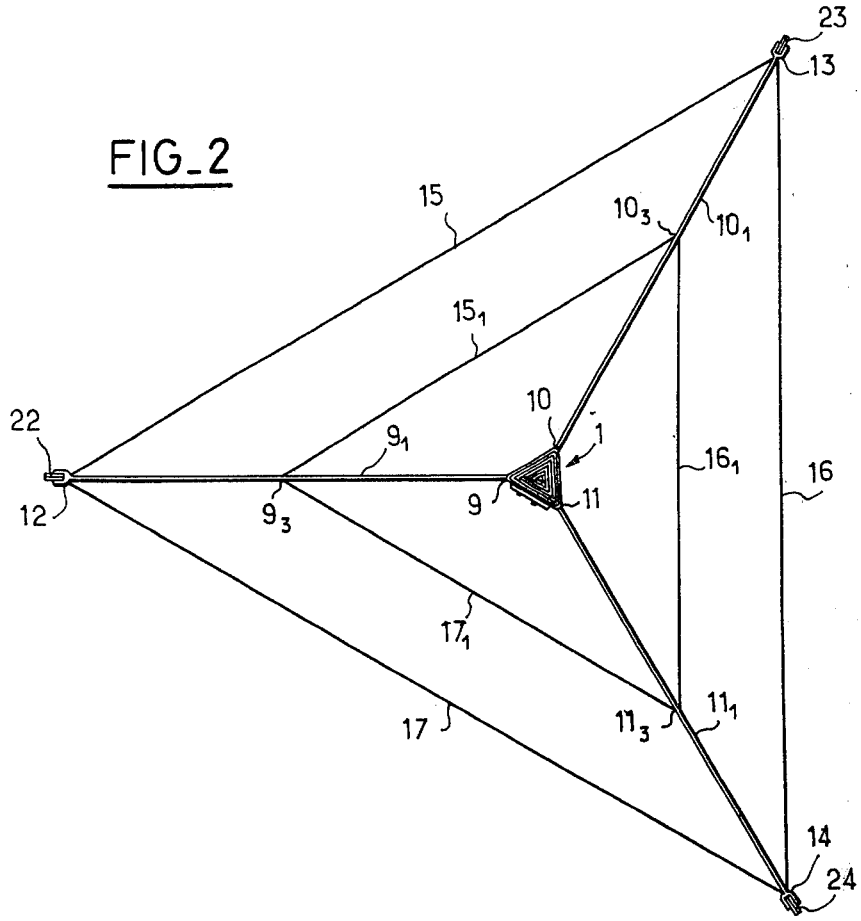
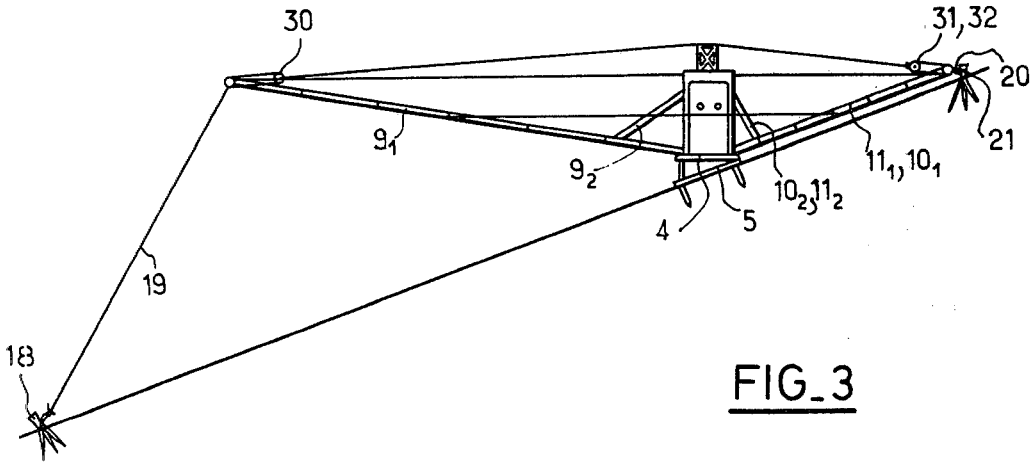
FIG_3

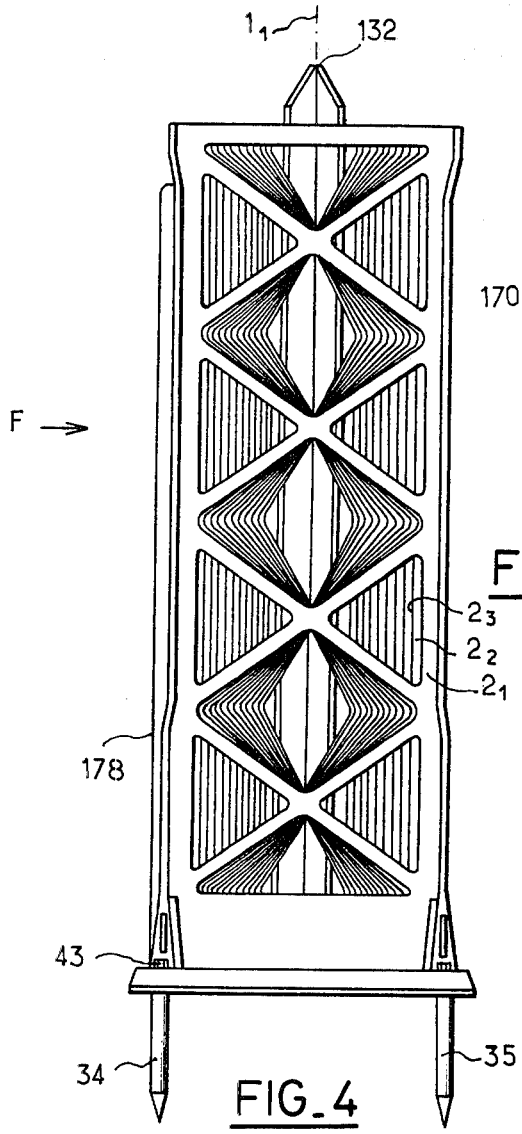
FIG_4
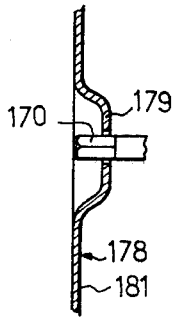
FIG_6
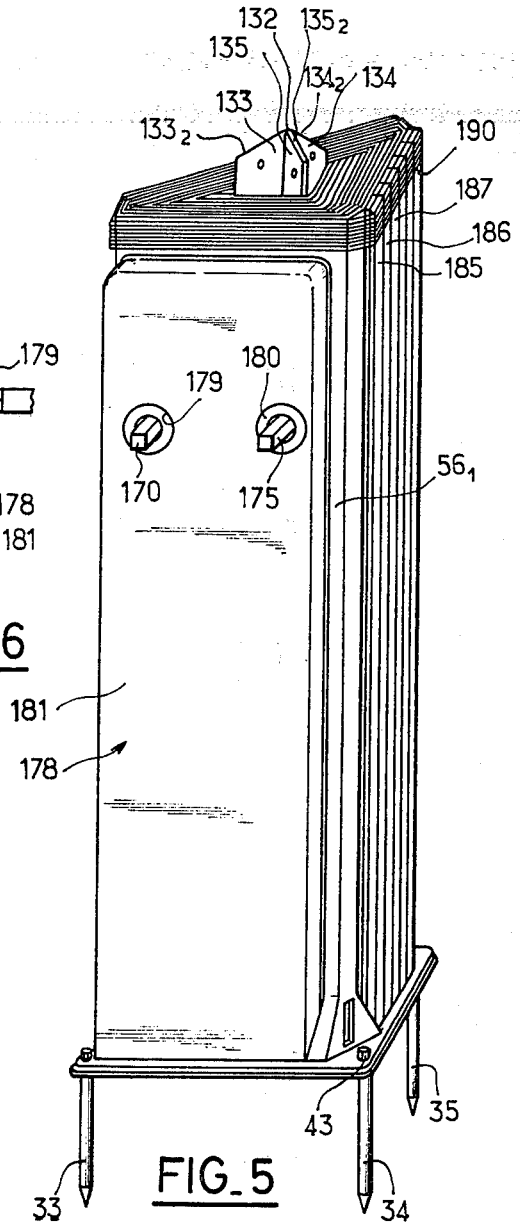
FIG_5
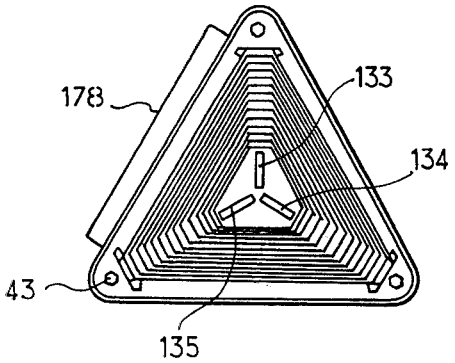
FIG_7
FIG_5a
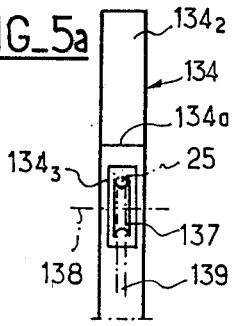

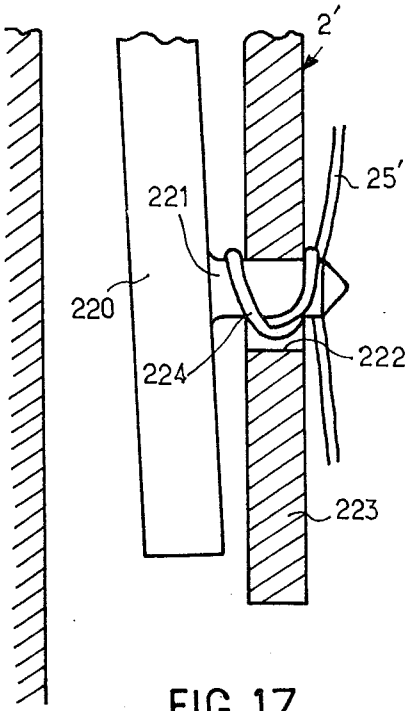
FIG_17
FIG_16
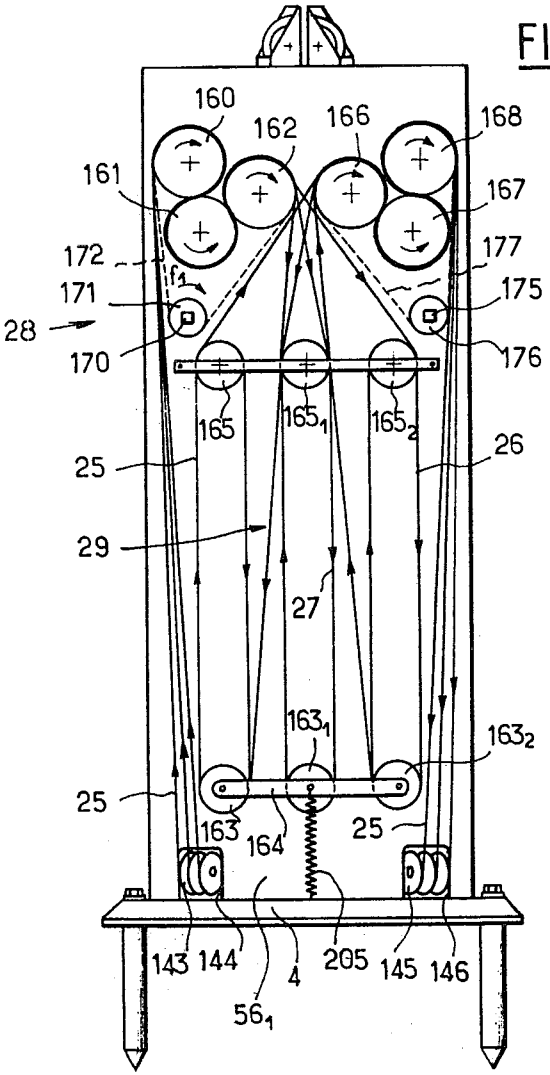
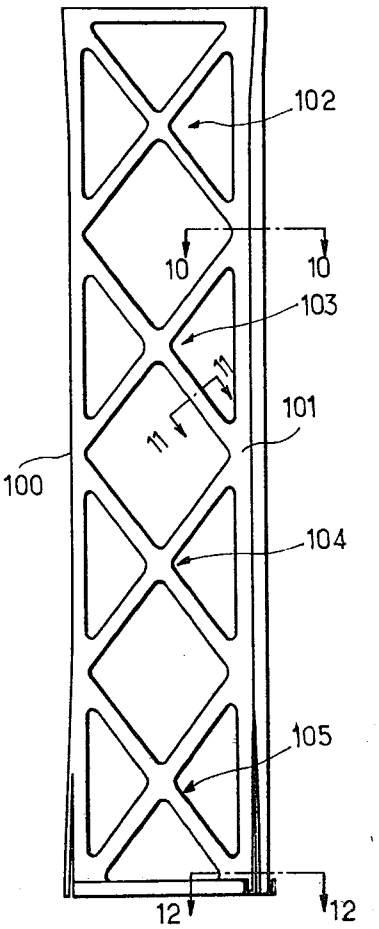
FIG_8

58
56
59
55
57
60
59
101
109
106
107
108
109
110
110
101
91
44
43
50₁
45₁
47₁
46₁
42
53
45₂
50₂
13a
43
52
6
34
34a
41
f₂
40
48₁
49₁
45₁
46₁
45
4
13a
7
5
48₂
52
52₃

FIG_15
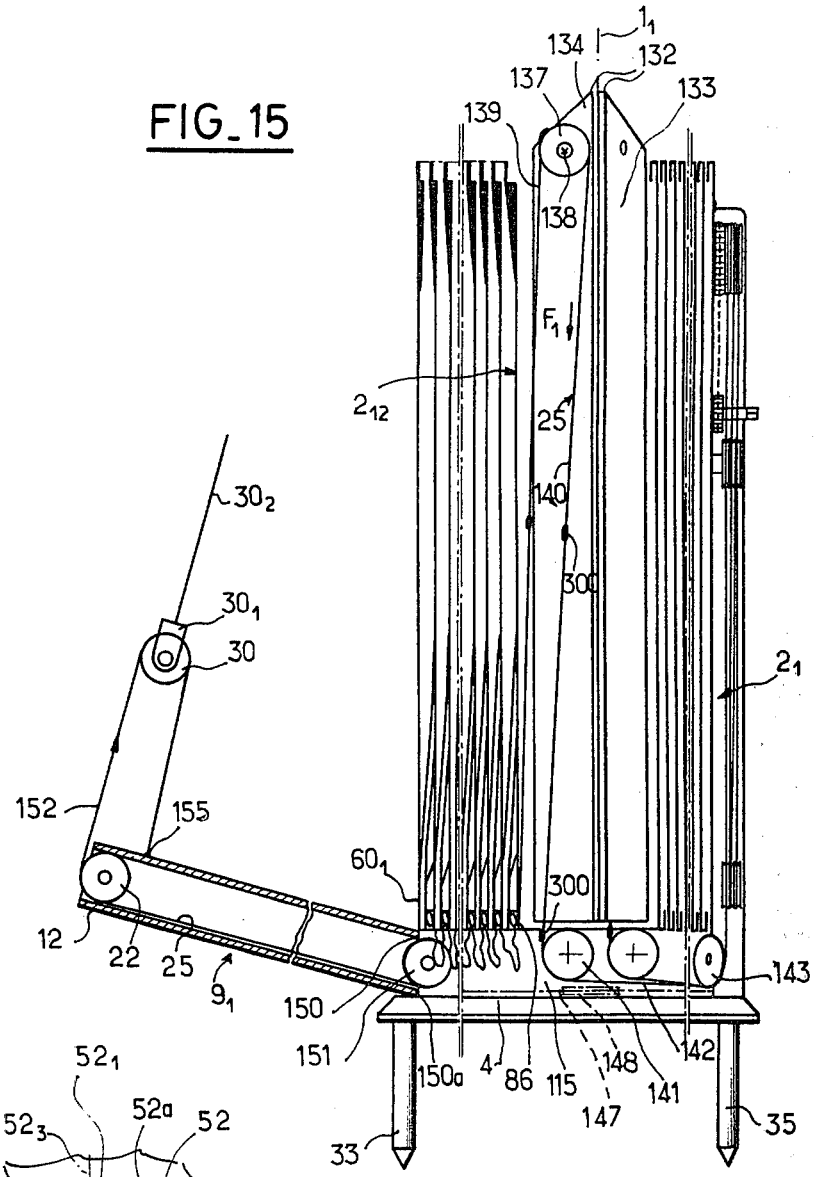
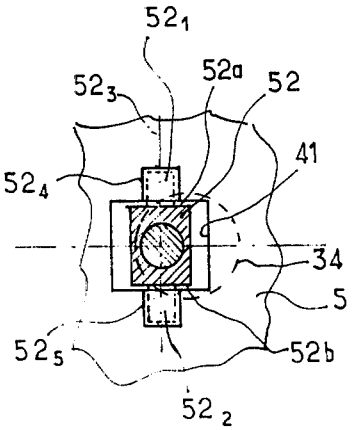
FIG_13a

FIG. 14
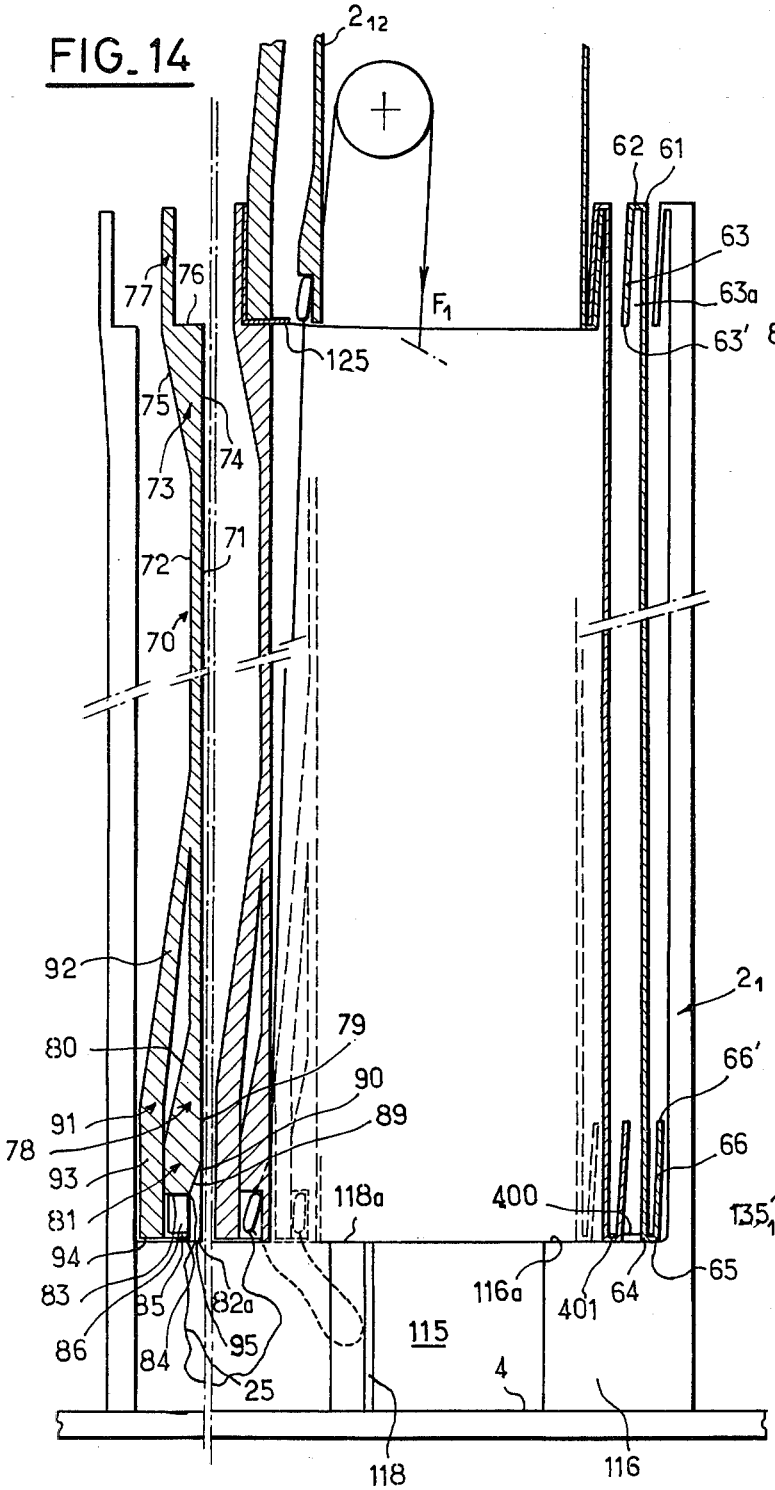
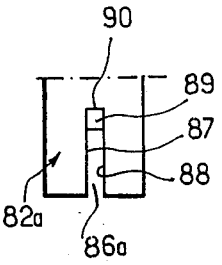
FIG. 14a
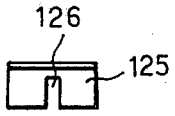
FIG. 14c
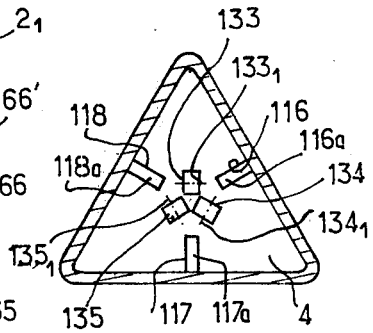
FIG. 14b

TELESCOPIC MAST

The invention relates to a mast, post, or any other construction or support, intended for being vertically erected.

Masts or posts of a great height are uneasy to transport and their setting in position is generally a lengthy and difficult operation calling upon the intervention of several workers.

This is why there has been proposed telescopic masts comprising elements slidably mounted into each other in order to facilitate their transportation, the sliding of one element in the element just below being carried out with the assistance of a hoisting cable.

But in most known masts of this type, the hoisting effort of each element is not strictly vertical, which may cause a wedging, which is an obstacle to the erection of the mast. However, a solution to this problem has already been proposed; but this solution is complex to carry out and needs for each element a large number of pulleys. Moreover, in the known telescopic masts, the connection to the elements of the hoisting cable in order to provide the sliding of the elements one after the other is also very complex. Finally, the means maintaining the elements rigidly connected to each other when the mast is erected are, in the known telescopic masts, relatively costly.

The invention remedies such disadvantages.

The telescopic mast according to the invention is characterized in that it comprises several hoisting cables actuated by the same winch and distributed so that the resultant of the hoisting forces they exert is vertical.

Thus, the erection of the mast may be carried out without incidents, the wedging risks being negligible.

For a maximum efficiency of the hoisting operation and in order that the cables be not stressed to a too great extent, it is preferably that each cable section which is directly connected to the element being hoisted is, from the beginning to the end of the hoisting operation, in a vertical direction or close to the vertical. To this effect, each cable runs on pulley which is above the elements when the mast is in a retracted condition, said pulley moving towards the hoisted element under the effect of the hoisted weight exerted on the pulley through the cable.

In the preferred embodiment of the invention, each cable being, before the erection, connected to all the elements and the erection of the mast being carried out by a sliding operation of the elements one after the other in the elements immediately below, the mast comprises means for separating the cables from the elements one after the other after the end of the sliding movement of each element. Thus, the cable connections to the elements may be particularly simple, without pulley, since one is free from the necessity of keeping the cables attached to the elements in the erected mast.

In one embodiment, the hoisting cables form also support stays and, during mast erection, the winch device winds the hoisting cable and at the same time unwinds the same cable in its portion forming the stay. Then, it is advantageous that the winch device comprises a cable accumulator allowing maintaining the stays tight in spite of the difference between the cable length which is wound for hoisting an element and the cable length which has to be unwound for obtaining the necessary stay length increase during hoisting.

The telescopic mast elements are preferably made of plastic, particularly of reinforced plastic, and for retaining the mast erected, said elements—with the exception of the base element—comprise in their lower portion a resilient lug attached to one wall of the element and formed when moulding the body of said element, said lug moving away from the wall when the element has come out of the element below in order to be able to sit on a platform formed on said lower element in its upper portion.

Such means which prevent the undesired retraction of the mast, are particularly simple to manufacture and use.

Embodiments of the invention will now be described in more detail, reference being made to the accompanying drawings wherein:

FIG. 2 is a view from above of the mast in its retracted condition;

FIG. 3 is a view similar to that of FIG. 1, but with the mast at the beginning of its erection;

FIG. 4 is a side view of the mast in its retracted condition;

FIG. 5 is a perspective view according to arrow F of FIG. 4;

Figures 1, 5B:
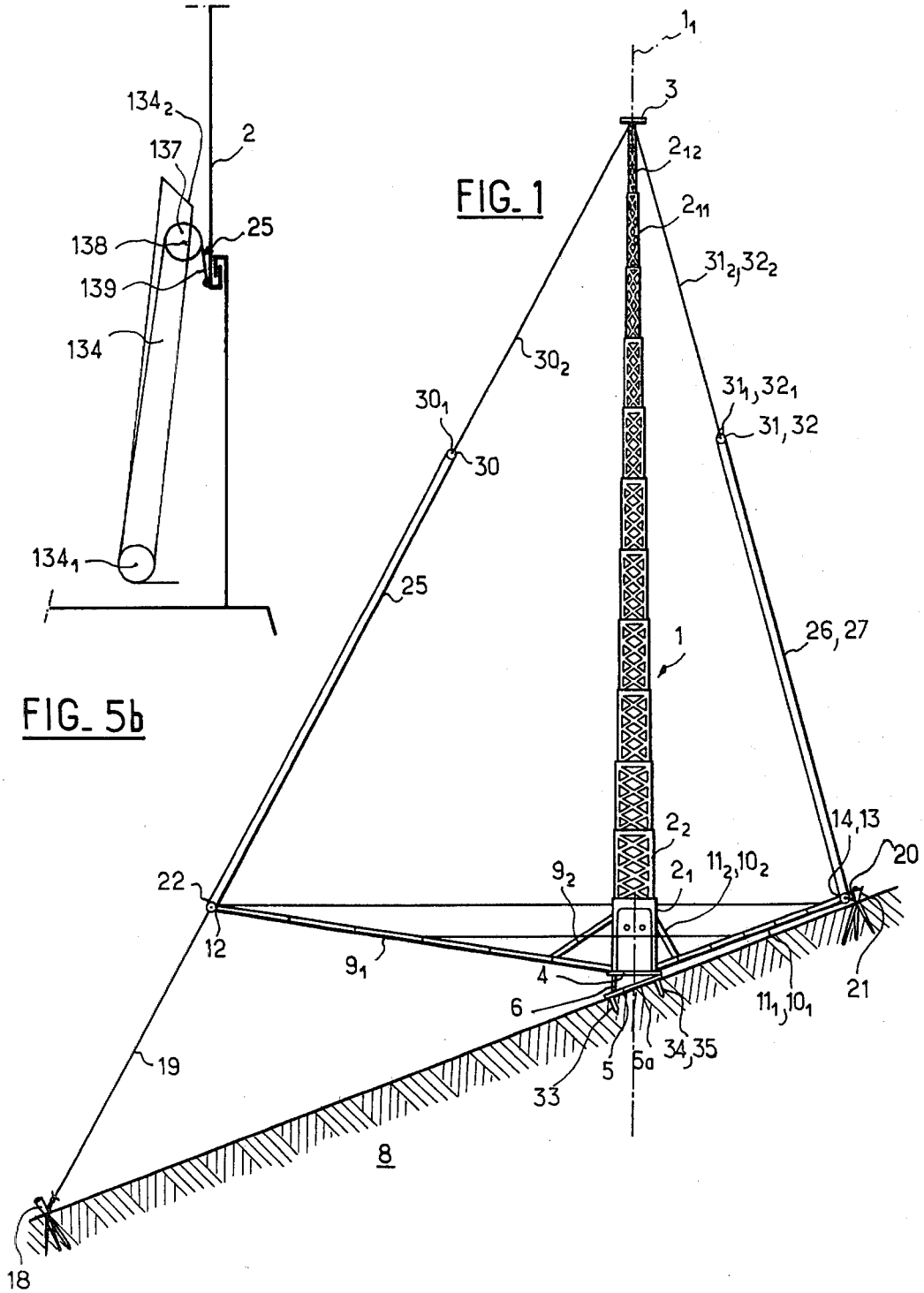
FIG. 1 shows the mast erected.
Figures 9, 10, 11, 12, 13:
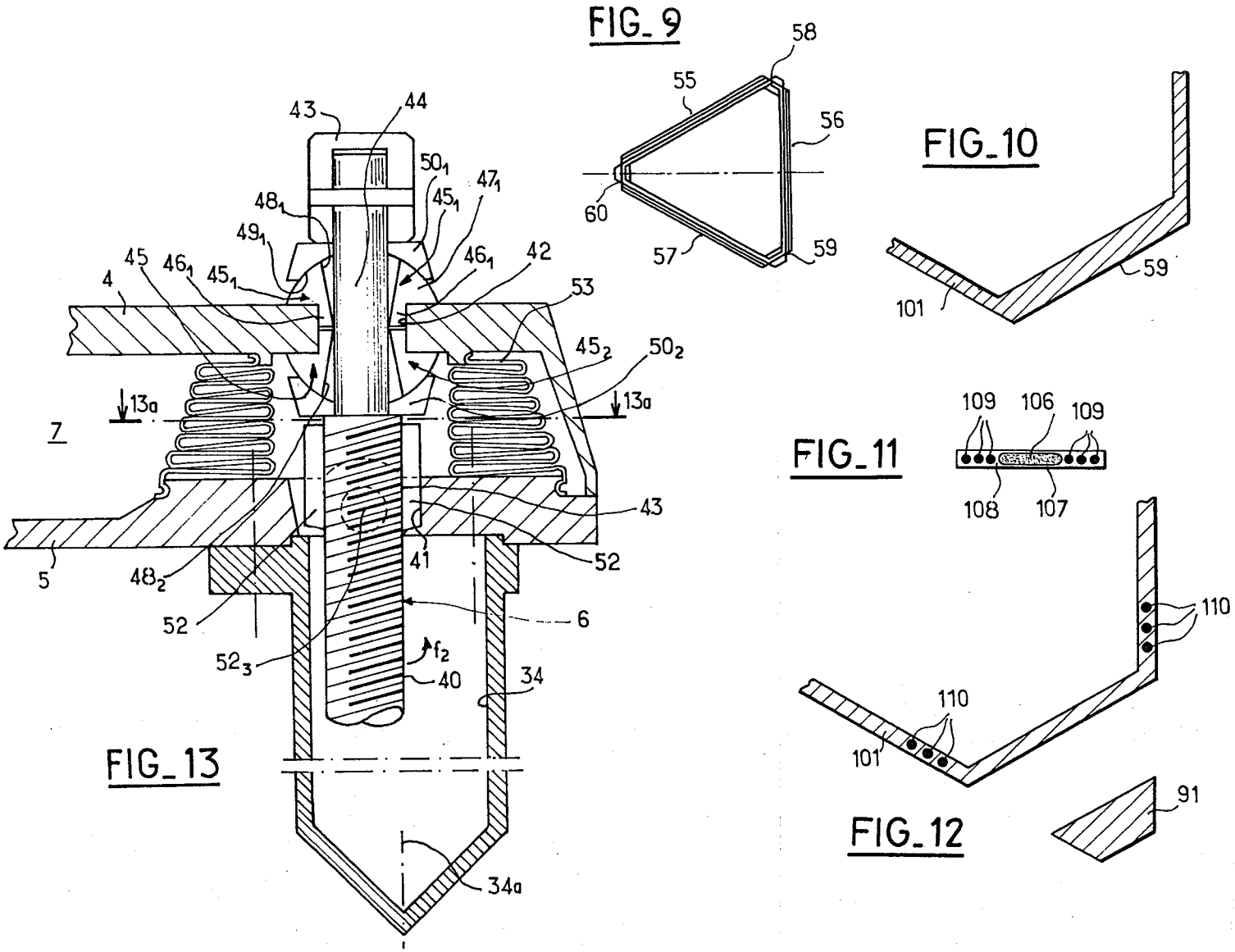

FIG. 5*a* shows the top of a vertical arm;

FIG. 5*b* is a diagram showing a mast and elements of the mast body;

FIG. 6 is a cross-sectional view showing at a larger scale a detail of the mast shown in FIG. 5;

FIG. 7 is a top view of FIG. 4;

FIG. 8 shows an element of the mast body;

FIG. 9 is a top view of the element shown in FIG. 8;

FIG. 10 is a cross-sectional view at a larger scale along line 10—10 of FIG. 8;

FIG. 11 is a cross-sectional view at larger scale along line 11—11 of FIG. 8;

FIG. 12 is a cross-sectional view at a larger scale along line 12—12 of FIG. 8;

FIG. 13 is a vertical cross-sectional partial view of the mast base;

FIG. 13*a* is a cross-sectional view along line 13*a*—13*a* of FIG. 13;

FIG. 14 is a vertical cross-sectional view showing schematically the mast being erected;

FIG. 14*a* shows a portion of an element of the mast body;

FIG. 14*b* shows the bottom of the base element of the mast body;

FIG. 14*c* shows an end of a resilient lug of an element of the mast body;

FIG. 15 is a vertical cross-sectional general schematic view of a mast in its retracted condition;

FIG. 16 shows a winch device; and

FIG. 17 shows a portion of an element of the mast body for an alternative embodiment.

The telescopic mast comprises (FIGS. 1 to 3) a mast body formed of twelve elements $2_1$ to $2_{12}$ slidably mounted into each other; elements $2_2$ to $2_{12}$ are all of the same height whereas the base element $2_1$ has a height slightly more important. Each element has, in a horizontal cross-section, the shape of equilateral triangle. The top element $2_{12}$ is adapted to support, for example, a platform 3 provided for an antenna (not shown).

The lower element $2_1$ comprises a base plate 4, also shaped as an equilateral triangle, connected through three jacks, such jack 6, in the vicinity of its apexes to an other plate 5 of same shape and size forming a stand.

The jacks allow bringing base 4 away from stand 5 so as to maintain the mast vertical even if the stand is sitting, as is shown in FIG. 1, on a sloping ground 8.

To the vertical ridges 9, 10 and 11 of the lower element $2_1$ are articulated, in the vicinity of the base plate 4, tubular booms respectively $9_1$, $10_1$ and $11_1$ (FIG. 1), the ends 12, 13, 14 of which are remote from the mast being practically at the level of the upper portion of element $2_1$. Short windbracing bars $9_2$, $10_2$, $11_2$ are placed between the booms and the corresponding upper portion of ridges 9, 10, 11 (FIG. 2) and allow maintaining the booms in a fixed position relative to the base element $2_1$.

The respective ends 12, 13 and 14 of the booms $9_1$, $10_1$ and $11_1$ define an equilateral triangle (FIG. 2) and between these ends are stretched cables 15, 16 and 17. Further cables $15_1$, $16_1$ and $17_1$ are stretched between the middles $9_3$, $10_3$, $11_3$ of the booms. Said cables $15_1$, $16_1$ and $17_1$ contribute, as the windbracings $9_2$, $10_2$, $11_2$ in maintaining the booms in position and to form a rigid assembly.

To the ends 12, 13, 14 are fixed further cables providing the fixation of the mast on the ground. Thus, between the end 12 of boom $9_2$ and a post 18 stuck in the ground is stretched a cable 19 which is in the same vertical plane as boom $9_1$. A short cable 20 is stretched between the end 14 of boom $11_1$ and a further stake 21 in the ground. Finally, another short cable is stretched between the end 13 of boom $10_1$ and a corresponding stake in the ground.

The ends 12, 13, 14 of the booms also carry pulleys, respectively 22, 23, 24 on which run further cables 25, 26 and 27 (FIGS. 1, 15 and 16) the displacement of which in one direction or the other is controlled by a winch mechanism 28 with cable accumulator 29 described hereinafter in connection with FIG. 16. Said cables constitute at the same time the staying and the hoisting cables. Each cable 25, 26, 27, in its staying portion, runs on a respective pulley 30, 31, 32 the axis of which is connected to a fork $30_1$, etc. (FIGS. 1 and 15) to which is fixed the end of a cable 32 . . . being also part of the staying, the other end of which is fixed to the upper portion of element $2_{12}$ (FIG. 1).

Each cable 25, 26, 27 runs also inside the corresponding tubular boom from where it is returned towards the winch mechanism 28 then, from said mechanism, inside the elements so as to control the mast erection.

During erection, the tensions applied on the stays tied to element $2_{12}$ have all the same value and due to the regular position of said stays at 120° from each other around the vertical axis $1_1$ of the mast, the component of said three tensions is vertical, thereby contributing to mast stability.

Three tubular stakes 33, 34, 35 housing partly the jacks are protruding from the lower face 5*a* of stand 5 for maintaining said stand 5 fixed to the ground.

Each jack, such as jack 6 associated with the tubular stake 34 comprises (FIGS. 5, 13 and 13*a*) a threaded rod 40 extending across stand 5 through an opening 41 and continued by a smooth rod 44 extending across a part 45 mounted in a hole 42 of plate 4 and ending into a head 43 of hexagonal or square cross-section above plate 4.

Part 45 is made of two portions $45_1$ and $45_2$ on either side of plate 4, which are symmetrical relative to the medium plane of said base. Part $45_1$ has a tubular cylindrical lower portion $46_1$ and a portion $47_1$ in the shape of a spherical cap the centre of which is on the axis of hole 42 and the radius of which is larger than that of the hole. Opening $48_1$ formed in said part $45_1$ has a frustoconical shape flaring out towards the outside.

The spherical bearing of portion $47_1$ of part $45_1$ engages another concave bearing $49_1$ formed on the lower face of a ring $50_1$ rigidly connected to rod 44. Similarly, a ring $50_2$ rigidly connected to rod 44 engages the spherical bearing of part $45_2$ below plate 4.

The threading rod 40 engages the tapping of a screw 52 of rectangular or square outer shape (FIG. 13*a*) housed inside opening 41 and formed on two of its outer faces 52*a* and 52*b* with stubs $52_1$ and $52_2$ of same horizontal axis $52_3$ and journalled in bearings $52_4$ and $52_5$ formed in stand 5.

Bellows 53 surrounds the jack 6 in space 7 separating said base 5 from plate 4.

The axis common to rods 40 and 44 is offset towards the inside relative to axis 34*a* of the tubular stake 34, since these rods may move away from the vertical by a pivoting about axis $52_3$ on a single side, the one where is arrow $f_2$ in FIG. 13.

The flared out openings $48_1$ and $48_2$ are foreseen for providing pivoting about axis $52_3$ of rod 44 relative to plate 4. During said pivoting, the spherical bearings of parts $45_1$ and $45_2$ slide on the concave spherical bearings of rings $50_1$ and $50_2$.

Thus, and by acting on heads 43, one may bring the plate in a horizontal position although stand 5 is sitting on a sloping ground.

Each of elements $2_2$ to $2_{11}$ has in cross-section the shape of an equilateral triangle (FIG. 9), the apexes of which are truncated, forming small sides which are parallel to the sides opposite said truncated apexes. Thus, each element comprises three wide vertical walls 55, 56, 57 separated by narrow vertical walls 58, 59 and 60 parallel to the opposite wide walls.

The upper edge 61 (FIG. 14) of each wide wall is continued towards the inside by a short horizontal edge 62 from which depends downwardly a return wall 63 of small height relative to that of the element.

The lower edge 64 of each wide wall is continued towards the outside by a horizontal edge 65 from which depends upwardly a return wall 66 equal in length to the upper return wall 63.

The return walls 63 and 66 are oblique relative to the corresponding walls so that their free edge 63', 66' is more remote from the wide wall than their connection to the corresponding edge 62, 65.

Each narrow wall has, along its height, a central portion 70 (FIG. 14) of constant thickness with an inner face 71 and an outer face 72 and, above said central portion, a portion 73 of triangular cross-section with an inner face 74 continuing face 71 of central portion 70, an outer face 75 extending away from bottom to top from face 72 and an upper face 76 forming a platform. Portion 73 is continued by an end upper portion 77 of same thickness as the central portion 70 but offset towards the outside relative to the latter.

Each narrow wall comprises, below the central portion 70, a portion 78 of thickness increasing downwardly with an inner face 79 continuing face 71 and an outer face 80 extending away downwardly from face 79. Said wall portion 78 is continued downwardly by an other portion 81 which is thicker than the central portion and the inner face of which is in prolongation of faces 71 and 79 and which moreover is formed at its lower end with an outer notch 85 bounded by a horizontal ceiling 83 and a vertical face 84. Notch 85 is provided for housing an element 86 rigidly connected to cable 25, the number of cables being equal to the number of narrow walls.

The thinned out lower portion 82*a* of such narrow wall 58, 59, 60 is formed with a central slot 86*a* (FIG. 14*a*) with vertical edges 87 and 88 and an oblique ceiling 89 connected to the ceiling 83 of notch 85. The obliqueness is in a direction such that ceiling 89 emerges, along a ridge 90, in face 79 above ceiling 83.

The width of slot 86*a* is sufficient for providing a passage for cable 25, but insufficient for providing a passage for the element 86.

To each of the narrow walls 58, 59, 60 is connected, in its lower portion, a resilient lug 91, the resiliency rending to urge said lug away from the corresponding wall. Said lug comprises an oblique connecting portion 92 and a lower portion 93 which is thicker, the thickness being equal to the width of platform 76; the lower edge 94 of said lug is practically flush with the lower edge 95 of the narrow wall and is provided for sitting on platform 76 of the element in which it is directly housed after having slided upwardly said element for the mast erection. The lug 91 forms an integral part of the body of the corresponding element, being moulded in one piece with said body.

The lower edge 94 of the resilient lug 91 continues towards the inside through a horizontal edge 125 formed with a transverse slot 126 (FIG. 14*c*) the width of which, as that of slot 86*a*, is sufficient for providing a passage for the corresponding cable 25 but insufficient for providing a passage for an element 86.

The wide walls 55, 56, 57 are hollowed out (FIG. 8), with vertical uprights 100 and 101 connected by cross-pieces 102, 103, 104 and 105.

The elements 2 are made from reinforced plastic. In the example, the cross-pieces comprise an expanded foam core 106 (FIG. 11) encased inside a sleeving 107 made of glass fibres and embedded inside the plastic 108 and, on either side of the core, are carbon fibre strands 109. The uprights 100, 101 are also reinforced with carbon fibres 110 (FIG. 12).

The lower portion of element $2_{12}$ is similar to the lower portion of elements $2_2$ to $2_{11}$, its upper portion having however no platform 76 but the antenna support 3 (FIG. 1).

The upper portion of the element $2_1$ is similar to that of the other elements $2_2$ to $2_{11}$. On the contrary, its lower portion is of a different constitution and has neither return wall nor resilient lug. Said element $2_1$ has a height superior to the common height of the other elements, being formed in its lower portion with a hollow 115 (FIG. 15) between its bottom wall formed by the base plate 4 and the upper edges 116*a*, 117*a*, 118*a* of vertical ribs 116, 117, 118 erected on plate 4 perpendicularly to the large faces of element $2_1$ in their middles (FIG. 14*b*). The lower edges of the walls 58–60 and the resilient lug 9 of the other elements sit, when the mast is retracted, on said upper edges 116*a*, 117*a*, 118*a*. The cable sections, with a length at least equal to the height of each element $2_2$ to $2_{12}$, are housed, when in a slack state, in hollow 115 (FIGS. 14 and 15) between the ribs.

The central portion of stand 5 is formed with bearings (not shown) on which are pivotally mounted about horizontal axes $133_1$, $134_1$ and $135_1$ (FIG. 14*b*) vertical tubular arms of rectangular cross-section, respectively 133, 134, 135, each of said axes $133_1$, $134_1$, $135_1$ being parallel to the opposite side of element $2_1$. Thus, said vertical arms radiate at 120° of each other about the vertical central axis $1_1$ of the mast body. The tops 132 (FIG. 4) of said arms are above the upper edges of the elements when the mast is retracted (FIG. 15) and their upper ends $133_2$, $134_2$, $135_2$ (FIG. 5) are oblique. The small vertical face of said arms which merges into the lower ridge 134*a* of the oblique edge is formed with a window $134_3$ (FIG. 5*a*) providing a passage for cable 25 coming out from a pulley 137 of horizontal axis 138 which is also above the elements upper edges when the mast is retracted; a section 139 on one side of said pulley going to the oval element 86 at the base of element $2_{12}$ in the retracted condition of the mast and a section 140 (FIG. 15) of the other side penetrating hollow 115. Inside said hollow, the cable 25 is returned through another pulley 141 of horizontal axis placed at the base of arm 134 towards the horizontal section 142 which passes on a pulley 143 also of horizontal axis and a portion of which is inside hollow 115 and the other portion outside, said pulley extending across an opening 144 (FIG. 16) provided in wall $56_1$ of element $2_2$ on which is placed the winch mechanism 28 with cable accumulator 29.

Such a pulley return system is provided for each cable 25, 26, 27. The two other pulleys corresponding to pulley 143 for the other two cables 16, 27 are also mounted on a horizontal shaft and extend through wall $56_1$ by opening 144.

After its passage inside mechanism 28, the cable comes again inside hollow 115 passing on another pulley 145 having a portion inside hollow 114 and a portion outside the latter and extending across, to this effect, wall $56_1$ by an opening 146 in a symmetrical position with respect to opening 144 relative to the medium vertical axis of wall $56_1$. The two further pulleys corresponding to pulley 145 for the two other cables 26, 27 are mounted on a horizontal shaft and extend also through wall $56_1$ in opening 146. Cable 25 extends again across the hollow 115 by its horizontal section 147 (FIG. 15) close to the bottom wall 4 by being guided by a pulley 148 of vertical axis rigidly connected to said bottom wall 4. The cable 25 exits then from the hollow 115 through an opening 150 of the narrow wall $60_1$ of element $2_1$ where it is guided by a pulley 151 of horizontal axis.

Cable 25 extends then inside the tubular boom $9_1$ the lower end of which 150*a*, which is closer to axis $1_1$, surrounds opening 150 and carries at its other end 12 the pulley 22 of horizontal axis a portion of which is inside and the other outside the boom. When coming out from the boom, cable 25 has a section 152 extending upwardly and passing then on pulley 30 which is rigidly connected to fork 30, and is attached by its end 155 to the outer surface of boom $9_1$.

In the winch mechanism 28 (FIG. 16), cable 25 guided by pulley 143 passes first on about three quarters of a turn on a pulley 160 of horizontal axis which is in the upper portion of the outer face of wall $56_1$ of element $2_1$. The cable reaches then another pulley 161 also of horizontal axis immediately below pulley 160 and from said pulley 161 is returned towards another pulley 162 of horizontal axis and on a level intermediate between those of axes of pulleys 160 and 161, the cable surrounding also pulleys 161 and 162 on about three quarters of a turn. From pulley 162, cable 25 is directed towards the cable accumulator 29 comprising in its lower portion a pulley 163 of horizontal axis and rigidly connected to a horizontal bar 164 parallel to wall $56_1$ and adapted for sliding vertically along the outer face of said wall $56_1$ and, at its upper portion, on the same vertical, a further pulley 165 of horizontal axis. The bar 164 is urged downwardly by a spring 205.

The cable portion 25 coming from pulley 162 passes first on a lower pulley 63, then on an upper pulley 165, then again on pulleys 163 and 165 from where it is returned towards three further pulleys 166, 167 and 168 similar respectively to pulleys 162, 161 and 160. From pulleys 168, the cable is directed towards pulley 145.

During erection of the mat, pulleys 160, 161 and 162 are driven together in rotation in the direction of the arrows.

During retraction of the mast, it is pulleys 166, 167 and 168 which are driven in rotation, but in a direction contrary to that of the arrows shown.

For preventing the cables to slide on the pulleys, the grooves of pulleys 160, 161, 162, 166, 167 and 168 are formed with housings for oval elements 86 and further oval elements 300 (FIG. 15) rigidly connected to the cables.

For driving pulleys 160, 161 and 162, there is provided a horizontal shaft 170 (FIG. 16) of rectangular, and for example square, cross-section, adapted for cooperating with a crank or a motor and to which is rigidly connected a pulley 171 on which is passed a cable or a chain 172 passing on driving pulleys (not shown), keyed on the same shafts as pulleys 160, 161 and 162, said chain or cable 172 running along the same path around the pulleys as cable 25 around pulleys 160, 161 and 162.

For driving pulleys 166, 167 and 168, there is provided in a similar way a horizontal shaft 175, a pulley 176, a chain or cable 177 and driving pulleys.

For cables 26 and 27, there corresponds to pulleys 160, 161 and 162 as well as 166, 167 and 168 two further sets of pulleys, similarly mounted on the same corresponding horizontal shafts, the belt or chain 172 or 177 driving thus simultaneously, and with the same tension, the three cables.

Accumulator 29 comprises two pulleys $\mathbf{165_1}$ and $\mathbf{165_2}$ of horizontal axis in the same horizontal plane as pulley 165 as well as two pulleys $\mathbf{163_1}$ and $\mathbf{163_2}$ rigidly connected to the horizontal bar 164, the pulleys $\mathbf{165_1}$ and $\mathbf{163_1}$ on the one hand, and the pulley $\mathbf{165_2}$ and $\mathbf{163_2}$ on the other hand being provided for guiding the cables, respectively 27 and 26.

Mechanism 28 is covered by a hood 178 (FIGS. 5 and 6) the main wall 181 being formed with two openings in the centre of bosses 179 and 180 convex towards wall $\mathbf{56_1}$ and provided for letting shafts 170 and 175 extend through wall 181.

Booms $\mathbf{9_1}$, etc . . . are made of a plurality of portions 185, 186, 187, etc. (FIG. 5), separable from each other, one end of each of said portions being adapted for fitting into an other end of an other portion, the length of said boom portions being preferably equal or lower than the height of element $\mathbf{2_1}$ so that for transportation, they may be applied against the faces of said element $\mathbf{2_1}$. In their transportation condition, the elements 185, 186 are retained by cables wound around the upper portion of the outer faces of element $\mathbf{2_1}$ as is shown at 190 in FIG. 5.

For erecting the mast, shaft 170 is turned in the direction of arrow $f_1$ (FIG. 16), thereby causing a displacement of cables 25, 26, 27 in the direction of arrows $F_1$ (FIGS. 14 and 15) and thus the erection of element $\mathbf{2_{12}}$ due to the cooperation of the oval elements 86 which are rigidly connected to the cables with the ceilings 83 of said element. When the outer lower return walls 66 of said element $\mathbf{2_{12}}$ are entirely introduced inside spaces 63*a* (FIG. 14) separating the upper inner return walls 63 of the corresponding wall of element $\mathbf{2_{11}}$ and when the lower edges of the resilient lugs $\mathbf{91_{12}}$ sit on platforms 76 of element $\mathbf{2_{11}}$, the cables 25, 26, 27 by an action in the reverse direction on shaft 170, are slackened so that the oval elements 86 come down underneath the lower edge of element $\mathbf{2_{12}}$ and thus the cables are separated from said element. The movement upwards of the other elements is carried out in the same way.

During erection, each tubular arm 132, 133, 134 (FIG. 5*b*) pivots about its respective axis $\mathbf{134_1}$ under the effect of the weight of the elements 2 which is applied on pulley 137 through the cable and therefore on said arm through axis 138 of the pulley. This pivoting movement brings pulley 137 nearer the element being hoisted and, in this manner, the section 139 of the cable remains substantially vertical even at the end of the hoisting of the element, the forces applied on the cable keeping thus all their efficiency for the hoisting operation.

The obliqueness of the upper edges $\mathbf{134_2}$, etc. bounds the friction surface of the arms against the inner faces of the element walls and, during the retraction, facilitates the pivoting movement of said arms towards vertical axis $\mathbf{1_1}$.

Downstream of the winch mechanism 28, the cables 25, 26, 27 unwind and are kept under tension due to the action of spring 205 of accumulator 29 exerting a downward traction on bar 164.

Accumulator 29 is adapted for difference compensation between the cable length which is wound for hoisting an element and the cable length which is unwound due to the elevation of elements 2. In fact, the length of cable wound, for the erection, is practically equal to the height of an element $\mathbf{2_2}$, $\mathbf{2_3}$ . . . , whereas the cable length which has to be unwound during erection is variable, being negligible during hoisting the first element $\mathbf{2_{12}}$ and increasing until it reaches practically the same length as that of the cable wound during hoisting of element $\mathbf{2_2}$.

As one foresees, for hoisting the elements, three cables on which the same traction is exerted and which are arranged regularly around the mast vertical axis, said cable portions which carry out the hoisting of the elements contribute to a correct hoisting, without wedgings.

Mast stability is provided by an important length, equal at least to 0.3 times the erected mast, of booms $\mathbf{9_1}$, $\mathbf{10_1}$, $\mathbf{11_1}$ which provide a support surface of great area.

The crank on shaft 175 may be used for increasing the tension exerted on the stays.

Pawl and ratchet means (not shown) are rigidly connected to the shafts on which are keyed the pulleys 161 and 167 for preventing a rotation in an undesired direction of said pulleys, i.e. the displacement in an undesired direction of the cables.

For retracting the mast, one uses pliers or a ring allowing bringing the resilient lugs 91 close to the corresponding walls, thereby allowing each element to penetrate into the element immediately below. During said operation, one turns shaft 175 so as to displace the cables in a direction contrary to arrow $F_1$ and, manually, one introduces progressively the oval elements 86 in notches 84 for rigidly connecting, again, the cables to the mast body elements.

For contributing to the maintenance in position of the elements in relation to each other, a horizontal stub 400 (FIG. 14) protrudes towards the inside from the lower edge of a large wall of each element and comes inside, in the retracted condition, a notch 401 formed in the lower edge of the wall of the element which is immediately above it in the erected condition.

FIG. 17 shows an alternative embodiment of the attachment of a cable 25' to an element 2'. In this example, the resilient lug 220 is formed with a stub 221 coming, in the retracted condition of the mast, inside an opening 222 of the narrow wall 223 with which it is associated and on which is wound a cable 25' forming a loop 224 around said stub.

When element 2' is brought above the element underneath, the resilient lug 220 moves away from wall 223 and stub 221 escapes from opening 222, the loop 224 sliding on the stub and escaping from the latter, which disconnects cable 25' from element 2'.

As an alternative, the cross-section of the elements is square shaped and not triangular shaped.

I claim:

1. A telescopic mast comprising several elements of the mast body slidably arranged in relation to each other and cable means for the erection of the mast, wherein the cable is, before the erection, connected to all the elements and the erection is carried out by a successive sliding of each element on the element below, said mast comprising means for separating the cable of each element after the end of the hoisting operation of said element.

2. A mast according to claim 1, which comprises means such that the section of each cable which is fixed to the elements being hoisted, is, from the beginning to the end of said hoisting operation, in a vertical direction or close to the vertical so that the traction they exert on each cable has a maximum efficiency for the hoisting operation.

3. A mast according to claim 1, characterized in that it comprises arms which are vertical before erection and which pivot about a horizontal axis at their base, said arms being in a number equal to the number of cables and arranged inside the elements, each of said arms having a height slightly superior to the common height of said elements and having at its upper portion a return and guiding pulley for a hoisting cable.

4. A mast according to claim 1, wherein each hoisting cable comprises a prolongation forming a stay.

5. A mast according to claim 4, which comprises a winch device on which, during erection of the mast, wind the hoisting cables and from which unwind the stays, said device comprising a cable accumulator adapted so that the same cable may wind and unwinding over different lengths while maintaining the stays under tension.

6. A mast according to claim 5, wherein the winch device is placed against an outer face of the base element of the mast body.

7. A mast according to claim 5, comprising booms in a number equal to the number of cables and at the end of each of which is a stay guiding pulley, the length of each boom being equal to at least 0.3 times the height of the erected mast.

8. A mast according to claim 7, wherein further cables are stretched between the free ends of the adjacent booms.

9. A mast according to claim 7, wherein said mast is fixed to the ground by stakes and cables stretched between the stakes and the boom ends.

10. A mast according to claim 7, wherein each boom comprises several elements associated by their ends fitted into each other, the length of each element being at most equal to the height of the mast in its retracted condition.

11. A mast according to claim 10, wherein, in the transportation condition, the boom elements are disposed on the outer faces of the retracted mast body against which they are retained by the hoisting and staying cables wound about said elements.

12. A mast according to claim 1, wherein, all the mast body elements, with the exception of the base element, comprise at their lower portion a resilient lug which is applied against a wall of the element in the retracted condition and which extends away from said wall, due to its resiliency, when the element has been extracted from the element below and sits then on a platform formed on said element below on its upper portion.

13. A mast according to claim 12, wherein the movement of the resilient lug away from a wall of the mast body element allows detaching the hoisting cable from said element.

14. A mast according to claim 13, wherein each cable is formed with organs housed inside an outer notch formed in the lower end of a corresponding wall of each element, the cable extending across said wall through a slot opened downwardly.

15. A mast according to claim 14, wherein the resilient lug is formed in its lower portion with a slotted edge providing a passage for the corresponding cable but preventing the organ to escape during erection and during transportation of the retracted mast.

16. A mast according to claim 13, wherein the resilient lug is formed with a stub penetrating inside an opening of the wall opposite the mast body element and on which the corresponding cable forms a loop in the retracted condition of the mast, said loop escaping from the stub when the resilient lug, and therefore the stub, moves away from said wall.

17. A mast according to claim 1, wherein the base element of the mast body is formed in its lower portion with a hollow in which hang the hoisting sections of the cables before erection of the mast.

18. A mast according to claim 17, wherein the hollow houses return and guiding pulleys for the cables.

19. Method for erecting with a cable a telescopic mast comprising elements slidably arranged in relation to each other, in which the erection is effected by successively sliding each element in the immediately inferior element, wherein the cable is, before erection, connected to all the elements to be hoisted and is degaged from each element after its hoisting through a loosening of the cable in the direction opposite to the hoisting direction.

* * * * *